United States Patent [19]

Kampfer et al.

[11] 4,164,048

[45] Aug. 14, 1979

[54] COMBINATION SINK TRAP ACCESS PORT FILTRATION DEVICE

[76] Inventors: John H. Kampfer, 2026 Bradley St., Apt. 1, St. Paul, Minn. 55117; Michael L. Kampfer, 2322 E. Cowern Pl., N. St. Paul, Minn. 55109; Philip A. Martens, 6011 W. Bald Eagle Blvd., White Bear Lake, Minn. 55110

[21] Appl. No.: 866,054

[22] Filed: Dec. 30, 1977

[51] Int. Cl.[2] ..... E03C 1/282; E03C 1/26; F16L 55/24; B01D 35/16

[52] U.S. Cl. ..... 4/292; 4/DIG. 14; 137/247.41; 210/236; 210/435

[58] Field of Search ..... 4/191, 197, 206, 207, 4/255, 257, 286–292, 293, 295, DIG. 14; 222/156, 159; 116/117 R; 210/299, 447, 236, 435; 137/247.41, 247.51

[56] References Cited

U.S. PATENT DOCUMENTS

| | | | |
|---|---|---|---|
| 1,217,763 | 2/1917 | Hirrich | 4/DIG. 14 |
| 1,817,376 | 8/1931 | Izquierdo | 4/DIG. 14 |
| 2,552,744 | 5/1951 | Smith | 210/447 |
| 2,971,650 | 2/1961 | Miranda | 210/447 |
| 3,185,128 | 5/1965 | Moore et al. | 222/159 X |
| 3,314,086 | 4/1967 | Minella | 4/288 |
| 3,672,749 | 6/1972 | Roser | 116/117 X |
| 3,834,539 | 9/1974 | Thompson | 210/447 X |
| 3,935,602 | 2/1976 | Kale | 210/435 X |
| 4,045,351 | 8/1977 | Peterson | 4/292 X |

FOREIGN PATENT DOCUMENTS

| | | | |
|---|---|---|---|
| 15343 | of 1928 | Australia | 4/293 |

*Primary Examiner*—Stuart S. Levy
*Attorney, Agent, or Firm*—Wicks & Nemer

[57] ABSTRACT

A drain trap pipe with an access port and filtration member including a pipe having a straight portion terminating in a curved portion overlying the straight portion. A tubular extension is connected to and communicating with the pipe substantially at the juncture of said straight portion and said curved portion. The extension portion has formed on the inner surface thereof opposed channel formations into which the edges of a filtration member are inserted. The filtration member extends the length of the extension and the diameter of the pipe with a transparent cap on the outer end of the extension.

2 Claims, 4 Drawing Figures

COMBINATION SINK TRAP ACCESS PORT FILTRATION DEVICE

SUMMARY

The invention relates to an improvement in sink traps of the J type having a straight portion terminating in a curved portion overlying the straight portion for use with sink drains. It is an object of the invention to provide such a trap with a tubular extension formed at the juncture of the straight portion with the curved portion having an access opening with a closure cap therefor and a flat screen extending the length of the interior of the tubular extension and the diameter of the trap thereby providing a screen having an area substantially greater than any conventional J type trap screen. The screen collects and prevents debris and items from going through the trap and going down the drain. The point of collection is removed from the trap proper and therefore allows regular flow through the trap.

It is a further feature of the invention to provide opposed channel formations in the extension into which the screen easily fits through the access opening. The access extension also allows water to be obtained from the access which is caused to flow from the faucet of the sink and down the sink drain that connects with the trap. The access also allows for complete drainage of the trap and easy access for cleanout of the sink drain and the trap.

It is a further feature to provide a drain blocking member in combination with the screen which may alternatively be slipped into the channel formations and thereby block off the trap where it is desired to prevent the odor of sewer gases from passing upwardly from the trap and out the sink drain when the drain system is drained.

In the drawings forming part of this application:

Figure 1:
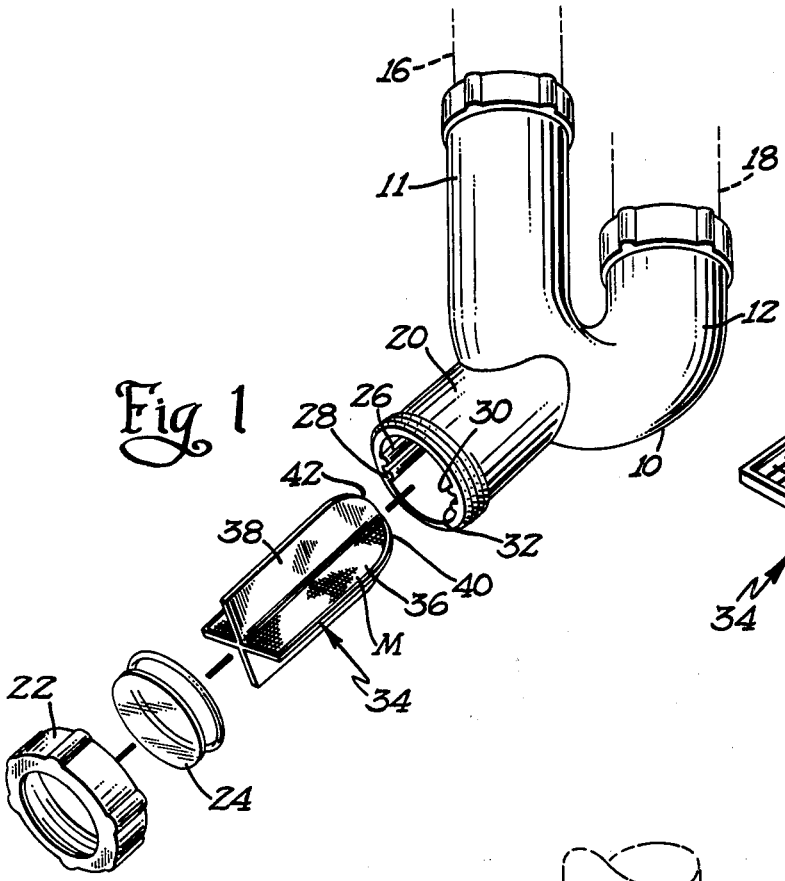
FIG. 1 is a perspective view of a combination sink trap access port filtration device embodying the invention.

Referring to the drawings in detail, the device A includes the conventional shaped J formation tubular sink trap pipe 10 having the straight portion 11 terminating in the curved portion 12 with the end of the curved portion underlying the straight portion. The pipe has the entry opening 13 and the exit opening 14. Secured to the opening 13 by means of the threaded ring 15 is the sink drain pipe 16, and secured to opening 14 by means of the threaded ring 17 is the drain pipe 18 which leads to a sewer pipe not shown. The trap 10 may be made of transparent plastic so that the type and amount of debris in the trap may be viewed.

The trap pipe 10 at the juncture of the straight portion 11 and the curved portion 12 has formed thereon the access hollow tubular extension portion 20 which communicates with the interior of the trap pipe 10. The portion 20 is closed off at the outer open end by a cap including the ring 22 which threadedly engages the outer end of the portion 20 and holds the transparent inspection disc 24 upon the end of the portion 20. Formed on the inside of the tubular position 20 are a first pair of spaced parallel ribs 26 and 28 which form a channel 29 and a second pair of spaced opposed parallel ribs 30 and 32 which form a channel 31.

Figure 3:
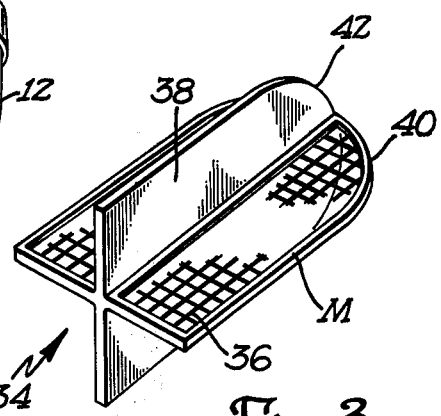
FIG. 3 is a perspective view of the filtering element.
Figure 4:
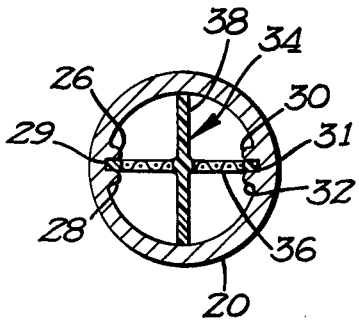
FIG. 4 is a sectional view on the line 4—4 of FIG. 2.
Figure 2:
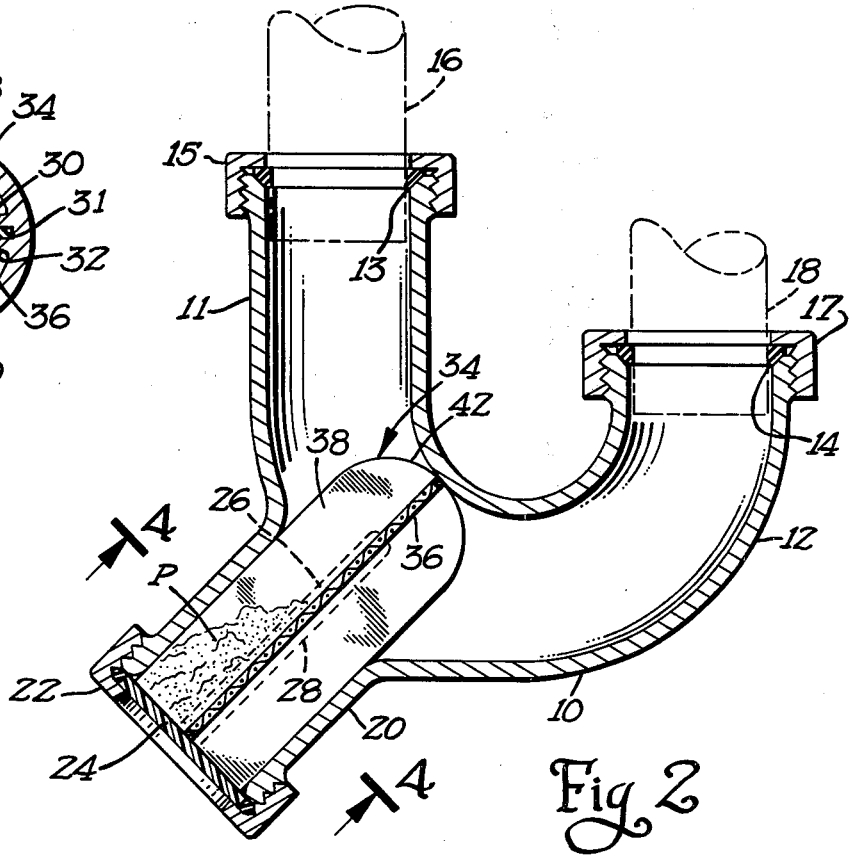
FIG. 2 is a sectional view of FIG. 1 in assembled condition.

The numeral 34 designates a removable combination filter and block member which includes the elongated flat screen portion 36 and the solid flat blocking portion 38 connected to the screen portion 36 at a right angle thereto. Each of the members 36 and 38 may be slotted so as to interfit to the position of FIG. 2 and 3 and be secured by a waterproof adhesive at the juncture, or the member 34 may be molded in one piece of plastic. The inner end of the screen 36 and the inner end of the flat solid blocking portion 38 are arcuately contoured as at 40 and 42, respectively, for contact with the inside surface of the trap pipe 10 when the member 34 is in position as in FIG. 2 as in the case of the screen. The blocking portion is similarly positioned with the end 42 in contact with the pipe 10.

With the ring 22 and the disc 24 removed from the access tubular portion the member 34 may be easily slipped into place by sliding the opposed edges of the screen 36 into the channels 29 and 31 or slidably removed therefrom. The member 34 may also be used as a blocking member by sliding the opposed edges of the flat solid portion into the channels 29 and 31. With the blocking member portion 38 positioned in the channels 29 and 31 reverse flow of sewer gases from pipe portion 18 are prevented from flowing up through pipe 16 when the trap is drained for winter or other reasons.

It will be seen that with the tubular portion 20 extended from the pipe 10 the screen 36 has considerable and relatively great length and area for filtering the drain water from pipe 16. The area of the screen 36 is substantially twice that of the cross-section of the pipe 10. Additionally, the tubular extended portion produces a form of pocket off of the general flow area in the area of P on the screen for catching debris but which area is removed from the flow area through the main portion of the pipe 10 thereby catching debris but allowing full flow through the pipe 10.

The access portion 20 when opened allows easy cleaning out of the pipe 10, the pipe 18 and the pipe 16 by means of a snake or the like. The access portion 20 when opened allows for easy filling of a container under the sink when the water supply to the sink is directed to and down the drain pipe 16 to the trap pipe 10. Further, the screen catches items such as rings, contact lenses at a point where the same may be easily retrieved. With the transparent disc 24 the catch area as at P may be easily viewed to ascertain the amount and type of debris that has collected and any item that requires retrieving.

Having thus described the invention, what is claimed as new and desired to be secured by Letters Patent is:

1. A combination sink trap access port filtration device comprising:

(a) a trap pipe having a straight portion terminating in a curved portion underlying said straight portion, (b) a downwardly extending tubular extension member connected to and communicating at its inner end with the trap pipe at the juncture of the straight portion and the curved portion, (c) the longitudinal axis of said tubular extension member being at an angle of about 135° from the longitudinal axis of said straight portion, (d) a screen extending the diameter and the length of the tubular extension and the diameter of the trap pipe at said juncture, (e) means in said tubular extension member for releasably mounting said screen comprising opposed channel formations on the inner surface of said extension in which the opposed edges of the screen are positioned, (f) said screen carrying a flat solid blocking member having the same formation and area of said screen, (g) said blocking member extending at a right angle to said screen for alternative insertion into said opposed channel formations, (h) said tubular extension, screen and blocking member forming a pocket wherein material caught by said screen and blocking member will build up in said tubular extension without interrupting fluid flow through said trap, and (i) a cap for the outer end of said tubular extension.

2. The device of claim 1 in which the screen is rectilinear.

* * * * *